US006371754B1

(12) United States Patent
Haynes

(10) Patent No.: US 6,371,754 B1
(45) Date of Patent: Apr. 16, 2002

(54) FLAME STABILIZING CHANNEL FOR INCREASED TURN DOWN OF GAS BURNERS

(75) Inventor: Joel Meier Haynes, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/477,530

(22) Filed: Jan. 4, 2000

(51) Int. Cl.[7] ..... F23D 14/74; F23D 14/06
(52) U.S. Cl. ..... 431/286; 431/350; 431/354; 431/349; 239/567
(58) Field of Search ..... 431/286, 266, 431/349, 354, 350; 126/39 E; 239/559, 552, 554, 555, 566, 567, 565, 568

(56) References Cited

U.S. PATENT DOCUMENTS

| | | | | |
|---|---|---|---|---|
| 3,796,535 A | | 3/1974 | DeGouville | |
| 4,757,801 A | | 7/1988 | LeMonnier deGouville et al. | |
| 5,104,311 A | | 4/1992 | Maughan et al. | |
| 5,133,658 A | | 7/1992 | LeMonnier deGouville et al. | |
| 5,246,365 A | | 9/1993 | Himmel et al. | |
| 5,408,984 A | | 4/1995 | Maughan | |
| 5,464,004 A | | 11/1995 | Maughan | |
| 5,488,942 A | | 2/1996 | Maughan | |
| 5,800,159 A | | 9/1998 | Maughan et al. | |
| 6,146,132 A | * | 11/2000 | Harneit | 431/354 |

FOREIGN PATENT DOCUMENTS

| | | | | |
|---|---|---|---|---|
| DE | 1950506 | * | 6/1980 | 431/349 |
| EP | 0534302 | * | 3/1993 | 431/354 |
| FR | 1304720 | * | 8/1962 | |
| FR | 1378211 | * | 10/1964 | 431/350 |
| FR | 2655711 | * | 6/1991 | 431/286 |
| IT | 505849 | * | 12/1954 | 239/553 |
| JP | 59-52113 | * | 3/1984 | 431/354 |
| JP | 60-11012 | * | 1/1985 | 126/39 E |
| JP | 61-128019 | * | 6/1986 | 431/354 |
| JP | 402089904 | * | 3/1990 | 431/286 |
| JP | 2-136606 | * | 5/1990 | 126/39 E |
| JP | 10-47681 | * | 2/1998 | 431/354 |

* cited by examiner

*Primary Examiner*—Carl D. Price
(74) *Attorney, Agent, or Firm*—Patrick K. Patnode; Christian G. Cabou

(57) ABSTRACT

A gas burner assembly for connection to a gas source includes a burner body having a sidewall and a main gas conduit. The burner body further includes a number of primary burner ports disposed within the sidewall, each for supporting a respective main flame. Additionally, a main fuel chamber is disposed within the burner body to provide fuel to the primary burner ports. A burner cap is disposed atop said sidewall. A stability channel is disposed within an outer portion of the burner cap. The stability channel is positioned adjacent the primary burner ports to capture a supply of gas and hot products from the burner assembly to re-ignite the primary burner ports after flameout. This configuration creates a repository of fuel and combustion products during normal burner operation within the stability channel for re-igniting the primary burner ports after flameout, thereby reducing the sensitivity of the burner assembly to pressure disturbances, while allowing a symmetric appearance to be maintained.

15 Claims, 7 Drawing Sheets

FLAME STABILIZING CHANNEL FOR INCREASED TURN DOWN OF GAS BURNERS

BACKGROUND OF THE INVENTION

This application relates to atmospheric gas burners, and in particular relates to improvements in gas burner flame stability.

Atmospheric gas burners are commonly used as surface units in household gas cooking appliances. A significant factor in the performance of gas burners is their ability to withstand airflow disturbances in the surroundings, such as room drafts, rapid movement of cabinet doors, and most commonly rapid oven door manipulation. Manipulation of the oven door is particularly troublesome because rapid openings and closings of the oven door often produce respective under-pressure and over-pressure conditions within the oven cavity. Since the flue, through which combustion products are removed from the oven, is sized to maintain the desired oven temperature and is generally inadequate to supply a sufficient airflow for re-equilibration, a large amount of air passes through or around the gas burners.

This surge of air around the gas burners is detrimental to the flame stability of the burners and may cause extinction of the flames. This flame stability problem is particularly evident in sealed gas burner arrangements, referring to the lack of an opening in the cooktop surface around the base of the burner to prevent spills from entering the area beneath the cooktop.

The inherent cause of this flame instability is the low pressure drop of the fuel/air mixture passing through the burner ports of a typical rangetop burner. Although there is ample pressure available in the fuel, the pressure energy is used to accelerate the fuel to the high injection velocity required for primary air entrainment. Relatively little of this pressure is recovered at the burner ports. A low pressure drop across the ports allows pressure disturbances propagating through the ambient to easily pass through the ports, momentarily drawing the flame towards the burner head and leading to thermal quenching and extinction.

An additional problem is that rapid adjustments of the fuel supply to a gas burner from a high burner input rate to a low burner input rate often will cause flame extinction when the momentum of the entrained air flow continues into the burner even though fuel has been cut back, resulting in a momentary drop in the fuel/air ratio, causing extinction.

Some commercially available gas burners employ dedicated expansion chambers to attempt to improve stability performance. These expansion chambers are intended to damp flow disturbances before such disturbances reach a respective stability flame. This damping is typically attempted by utilizing a large area expansion between an expansion chamber inlet and an expansion chamber exit, typically expanding by a factor of about ten. Accordingly, the velocity of a flow disturbance entering a burner throat is intended to be reduced by a factor of about ten prior to reaching a respective stability flame, thereby reducing the likelihood of flame extinction. Large area expansion and disturbance damping are not typically present in conventional main burner ports, making conventional main burner ports susceptible to flame extinction, especially at low burner input rates. Simmer stability is generally improved as the area expansion ratio is increased. If an expansion chamber inlet is sized too small, however, the gas entering an expansion chamber may be insufficient to sustain a stable flame at the expansion chamber port.

Commercially available gas burners, such as those described in U.S. Pat. No. 5,133,658 and U.S. Pat. No. 4,757,801, each issued to Le Monnier De Gouville et al., employ an expansion chamber to improve flame stability. The De Gouville gas burners have a plenum ahead of a number of main burner ports. An expansion chamber inlet is located in the plenum, adjacent the main flame ports. When a negative pressure disturbance enters the burner (suction, for example, from the opening of an oven door), the pressure drop and flow velocity through the main burner ports are momentarily reduced causing unwanted extinction of the main burner flames. The expansion chamber flame, however, is less susceptible to extinction due to the damping effect described earlier. Although such gas burners having an expansion chamber provide somewhat improved stability performance at simmer settings, disturbances continue to cause unwanted extinction. Furthermore, these expansion chambers have excessively large flames at higher burner input rates.

Commercially available gas burners, such as those described in U.S. Pat. No. 5,800,159 issued to James Maughan overcome the issue of excessively large flames using a stability chamber that is insensitive to turn-down. The stability chamber, however, is dissimilar to the flames from the other ports and gives the burner a non-symmetric flame appearance.

Accordingly, there is a need for an improved atmospheric gas burner that is better able to withstand airflow disturbances, especially during low burner input rates.

BRIEF SUMMARY OF THE INVENTION

A gas burner assembly for connection to a gas source includes a burner body having a sidewall and a main gas conduit. The burner body further includes a number of primary burner ports disposed within the sidewall, each for supporting a respective main flame. Additionally, a main fuel chamber is disposed within the burner body to provide fuel to the primary burner ports. A burner cap is disposed atop said sidewall. A stability channel is disposed within an outer portion of the burner cap. The stability channel is positioned adjacent the primary burner ports to capture a supply of gas and hot products from the burner assembly to re-ignite the primary burner ports after flameout. This configuration creates a repository of fuel and combustion products during normal burner operation within the stability channel for re-igniting the primary burner ports after flameout, thereby reducing the sensitivity of the burner assembly to pressure disturbances, while allowing a symmetric appearance to be maintained.

DETAILED DESCRIPTION OF THE INVENTION

Figure 1:
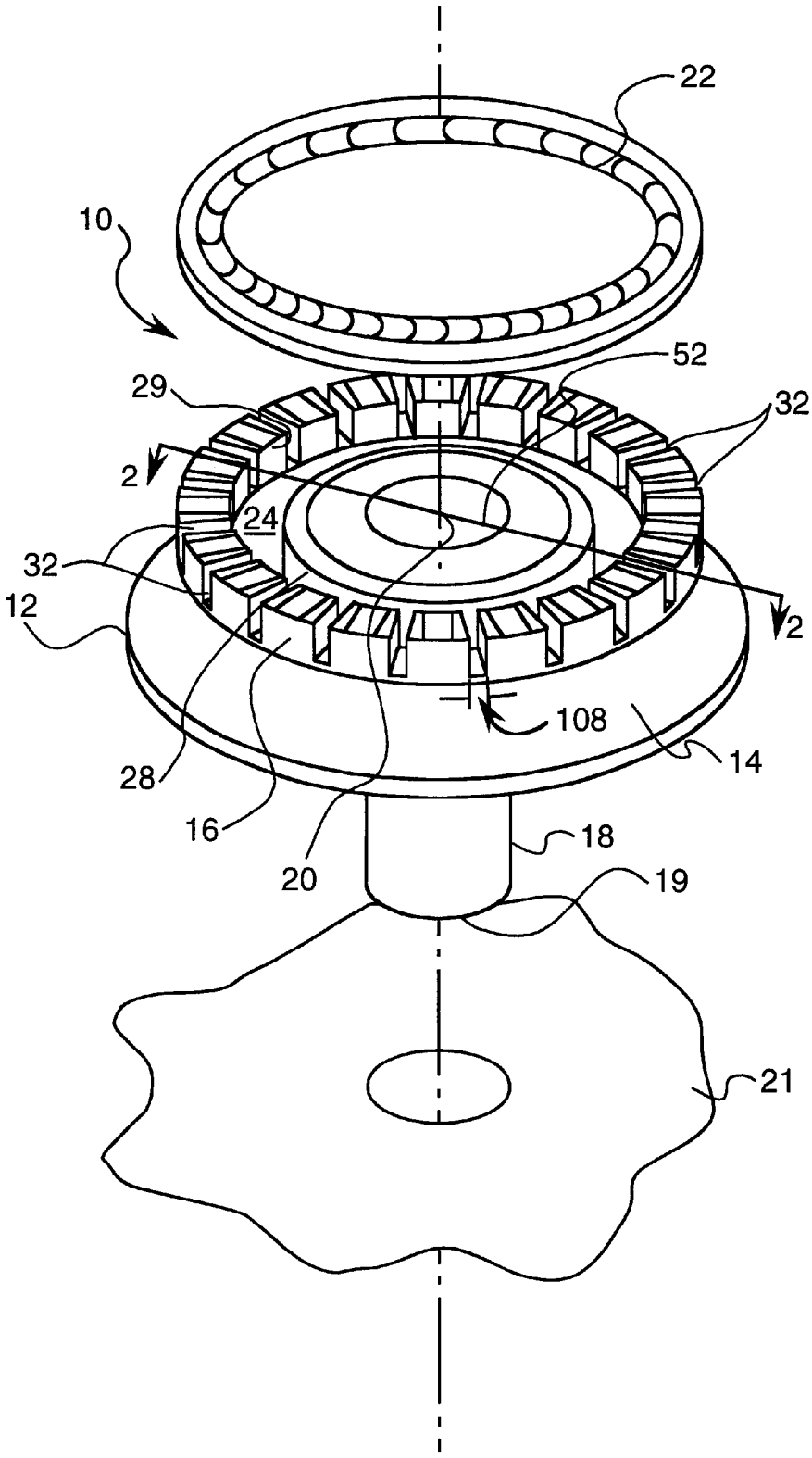
FIG. 1 is an exploded perspective view of a gas burner assembly in accordance with this invention.
Figure 2:
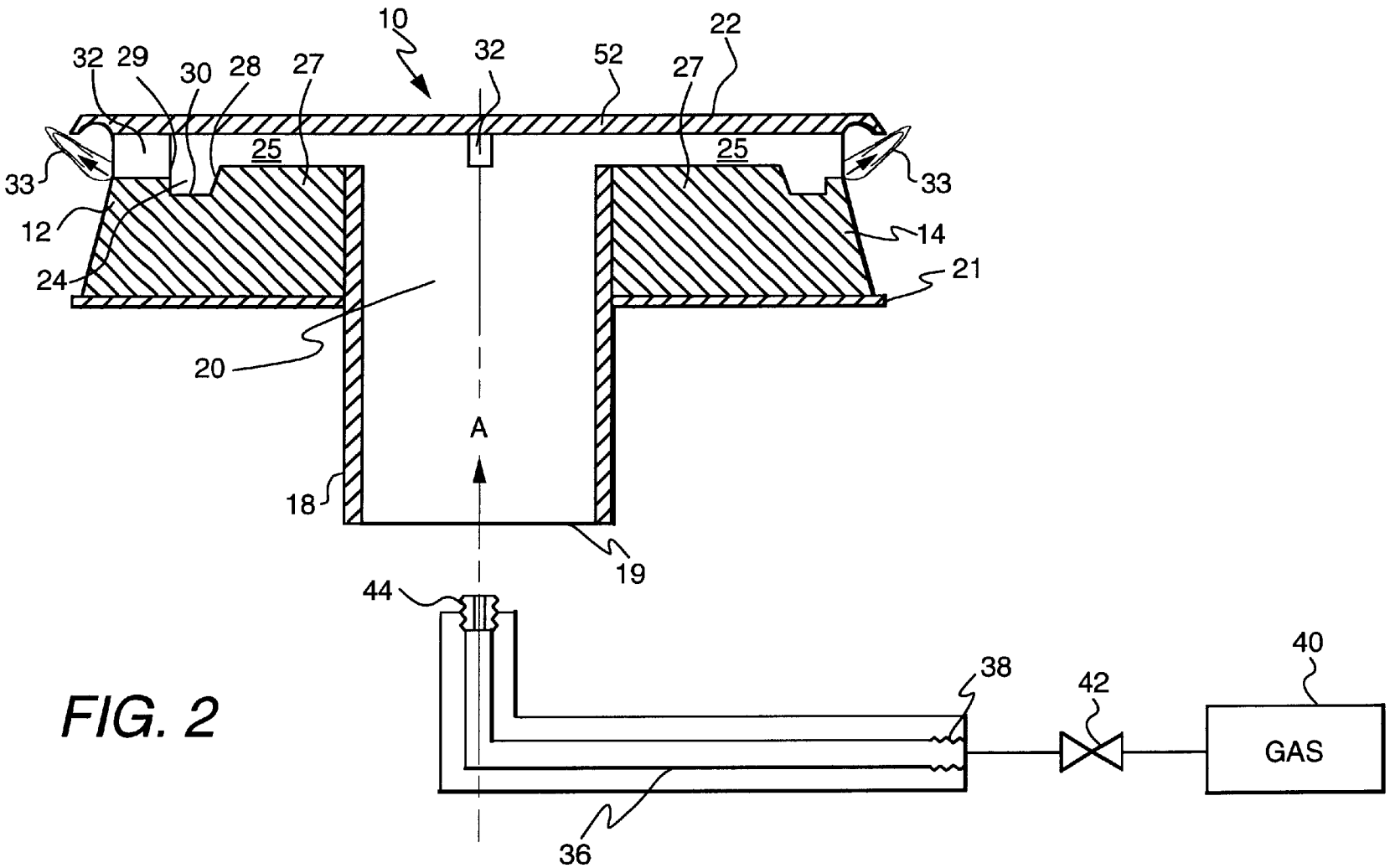
FIG. 2 is a cross-sectional plan view through line 2—2 of FIG. 1, in accordance with this invention.

An atmospheric gas burner assembly 10 includes a burner body 12 having a frustrum-shaped solid base portion 14 and a cylindrical sidewall 16 (FIG. 1) extending axially from the periphery of base portion 14, as shown in the illustrative embodiment of FIGS. 1 and 2. A main gas conduit 18 having an entry area 19 and a burner throat region 20 is open to the exterior of burner body 12 and defines a passage that extends axially through the center of burner body 12 to provide fuel/air flow along path "A" (FIG. 2) to burner assembly 10. As used herein, the term "gas" refers to a combustible gas or gaseous fuel mixture.

Burner assembly 10 is attached, in a known manner, to a support surface 21 (FIG. 1) of a gas cooking appliance such as a range or a cooktop. A cap 22 is disposed over the top of burner body 12, defining therebetween an annular main fuel chamber 24, an annular diffuser region 25 (FIG. 2). A toroidal-shaped upper portion 27 of burner body 12, immediately bordering burner throat 20, in combination with cap 22 defines annular diffuser region 25 therebetween. Cap 22 can be fixedly attached to sidewall 16 (FIG. 1) or can simply rest on sidewall 16 for easy removal. While one type of burner is described and illustrated, the instant invention is applicable to other types of burners, such as stamped aluminum burners and separately mounted orifice burners.

Annular main fuel chamber 24 is defined by an outer surface 28 of toroidal shaped upper surface 27, an inner surface 29 of sidewall 16, an upper surface 30 (FIG. 2) of base portion 14, and cap 22. A plurality of primary burner ports 32 are disposed in sidewall 16 (FIG. 1) of burner body 12 so as to provide a path to allow fluid communication with main fuel chamber 24, each primary burner port 32 being adapted to support a respective main flame 33 (FIG. 2). Primary burner ports 32 are typically, although not necessarily, evenly spaced about sidewall 16. As used herein, the term "port" refers to an aperture of any shape from which a flame may be supported.

A gas feed conduit 36 (FIG. 2) comprises a coupling 38 disposed on one end for connection to a gas source 40 via a valve 42 (shown schematically in FIG. 2). Valve 42 is controlled in a known manner by a corresponding control knob on the gas cooking appliance to regulate the flow of gas from gas source 40 to gas feed conduit 36. The other end of gas feed conduit 36 is provided with an injection orifice 44. Injection orifice 44 is aligned with main gas conduit 18 so that fuel, discharged from injection orifice 44, and entrained air are supplied to main fuel chamber 24 via main gas conduit 18 along path "A" of FIG. 2.

Figure 3:
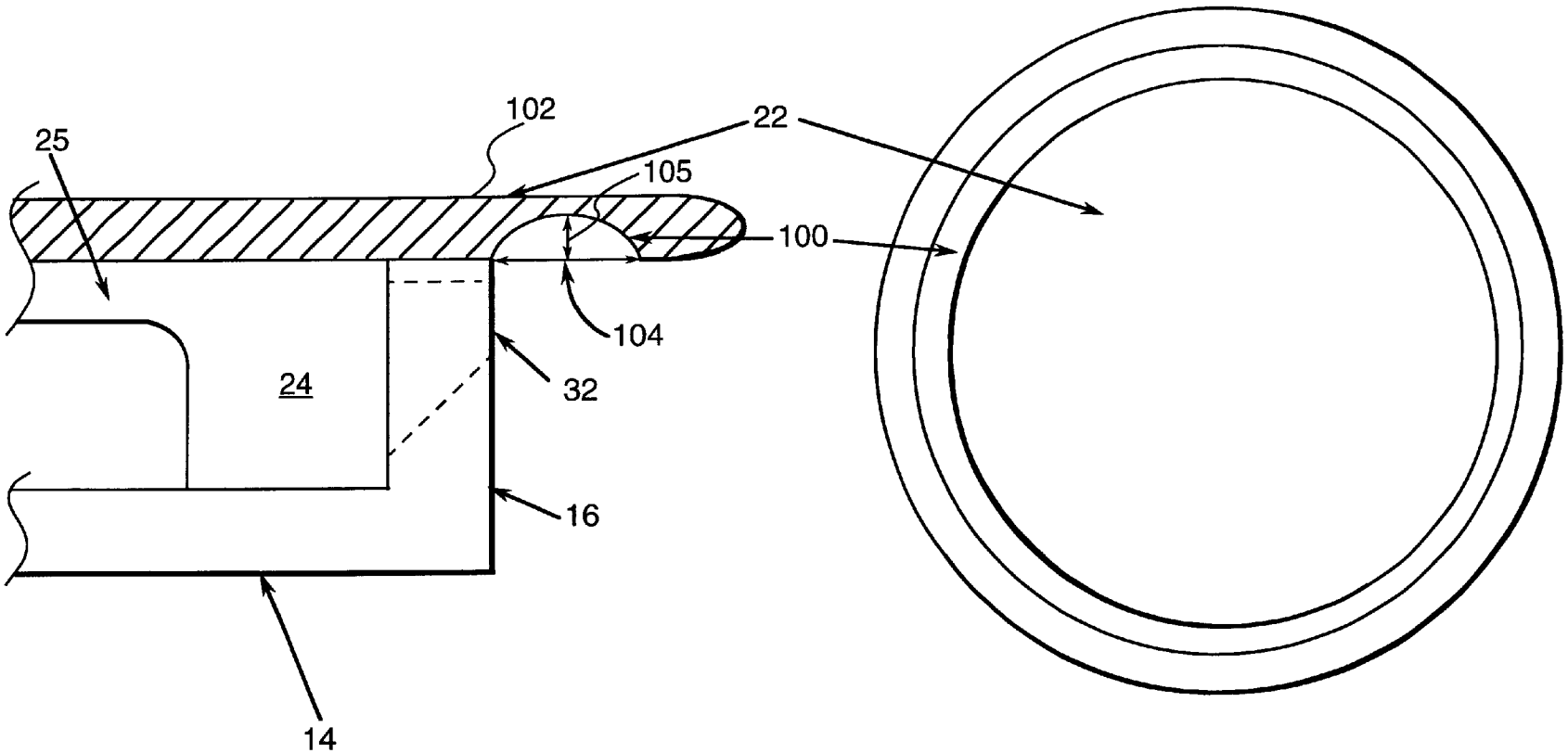
FIG. 3 is a fragmentary cross-sectional side and top view of a gas burner assembly in accordance with this invention.
Figure 4:
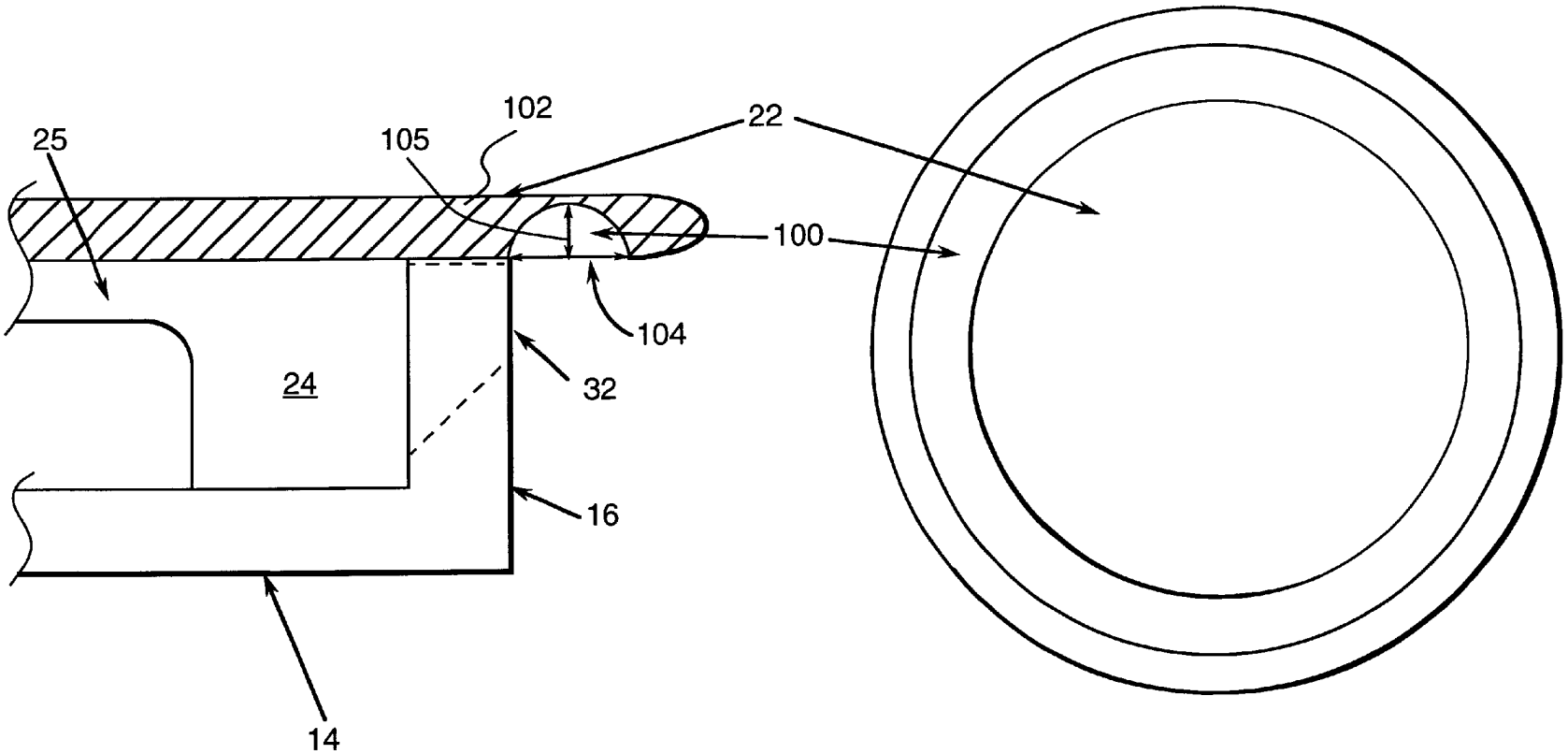
FIG. 4 is a fragmentary cross-sectional side and top view of a gas burner assembly in accordance with one embodiment of this invention.
Figure 5:
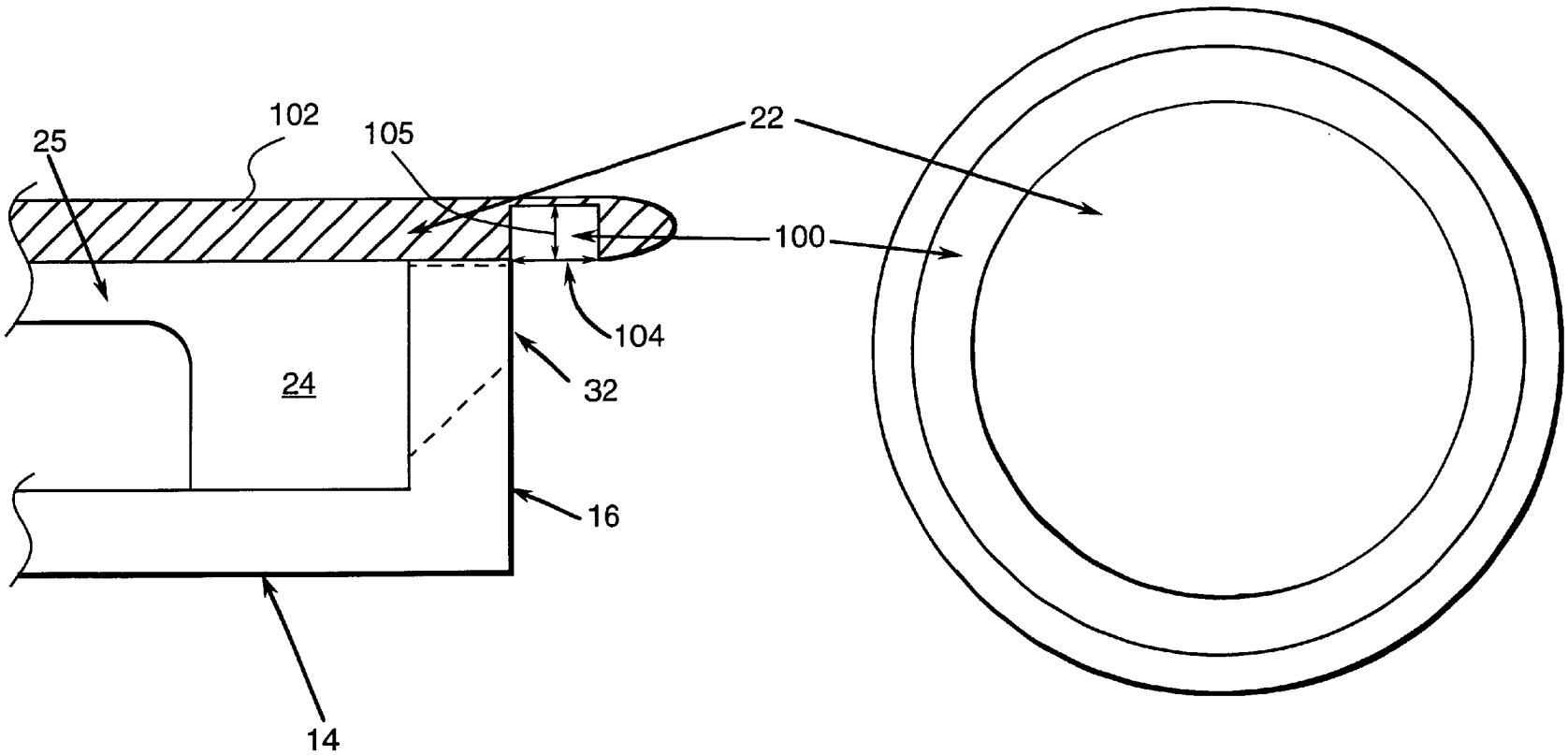
FIG. 5 is a fragmentary cross-sectional side and top view of a gas burner assembly in accordance with one embodiment of this invention.

In accordance with one embodiment of the instant invention, a stability channel 100 is disposed within cap 22, as shown in FIGS. 3–7. Cap 22 has an outer portion 102 that extends radially from sidewall 16. Stability channel 100 is positioned in outer portion 102 adjacent to primary burner ports 32. For example, in a circular burner head, stability channel 100 would be annular shaped, as shown in FIGS. 3 and 4. Stability channel 100 functions as a storage region for an amount of gas and hot combustion products. Primary flames 33 (FIG. 2) transport fuel and unburned combustion products to stability channel 100 where they are stored in a vortex flow pattern within stability channel 100. While stability channel 100 is shown and described as being disposed within cap 22, this does not limit stability channel 100 to use within cap 22. In fact, stability channel 100 may be disposed in any number of configurations, including being disposed within an outer flanged portion of burner assembly 10 that is disposed atop sidewall 16, or the like.

If flameout occurs and primary flames 33 are blown out, air mixes with the trapped fuel within stability channel 100 and sustains a flame front in stability channel 100. If the fuel air mixture for primary flames 33 resumes impingement on stability channel 100 within a short period of time, typically, 5–10 milliseconds, either stability channel 100 flame or the trapped hot products re-ignite the fuel exiting primary burner ports 32.

The shape of stability channel 100 cross section may be, for example, curved like a half-circle (FIG. 3 or 4) or a rectangular channel with one (FIG. 5) or more (FIG. 6) segments. Stability channel 100 volume is large enough to hold an adequate supply of gas and hot products to endure a short flame disruption at primary burner ports 32. Stability channel opening 104 is sized to be large enough to accept an adequate amount of gas from primary burner ports 32 and small enough to keep the effects local to the burner ports.

Figure 6:
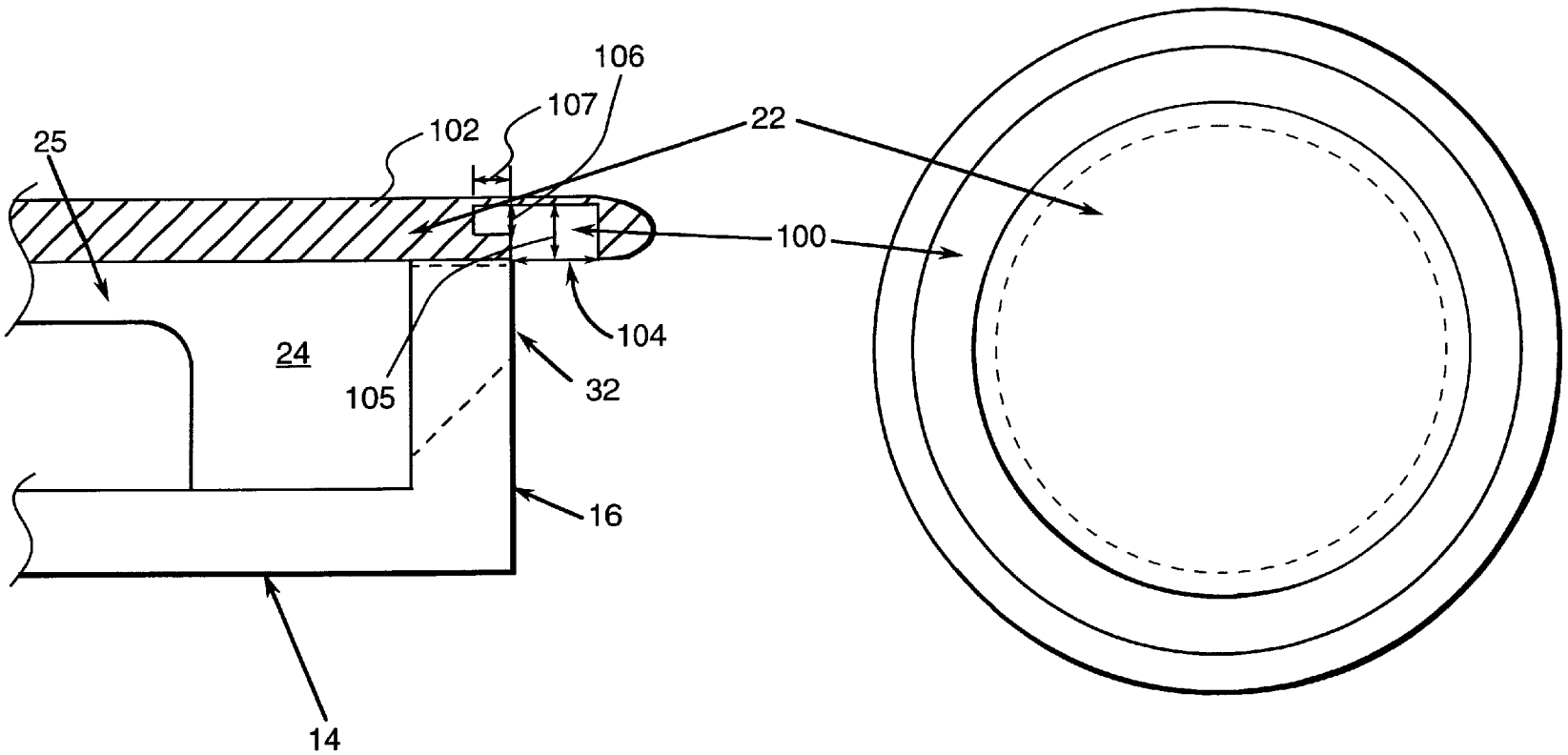
FIG. 6 is a fragmentary cross-sectional side and top view of a gas burner assembly in accordance with one embodiment of this invention.

The channel opening 104 is typically one to three primary burner port widths 108 (FIG. 1) in length. Stability channel height 105 is preferably between one-half a channel opening 104 and one channel opening 104. This range of channel aspect ratios is preferred because it supports a large vortex at the cavity entrance while keeping the required cap thickness as small as possible. FIG. 6 illustrates a compound cavity. The recommended channel opening 104 and height 105 for the primary channel are the same as for FIG. 5. The secondary channel opening 106 is between one-half and two-thirds the primary channel height 105. The secondary channel width 107 is preferably between one-half the secondary channel opening 106 and one secondary channel opening 106.

In operation, a control knob on the gas cooking appliance which corresponds to the desired gas burner assembly 10 is manipulated, thereby causing valve 42 (FIG. 2) to provide fuel to gas feed conduit 36. The fuel is discharged from injection orifice 44 and primary air is entrained to support combustion. The fuel/air mixture enters entry area 19 of main gas conduit 18 and flows along path "A" to burner throat 20 through annular diffuser region 25 to main fuel chamber 24, which main fuel chamber 24 supplies the fuel/air mixture to primary burner ports 32 for combustion by main flames 33.

If the control knob is manipulated to a position corresponding to high input, fuel/air flow increases into main gas conduit 18 and correspondingly increases into main fuel chamber 24, producing larger flames at primary burner ports 32, thereby creating the desired larger cooking flames. During operations at high burner input rates burner assembly 10 is relatively immune to stability problems due to the high velocity and momentum of the fuel exiting primary burner ports 32. Nevertheless, stability channel 100 remains functional. Stability channel 100 is filled with unburned fuel and hot products from primary burner ports 32. Secondary combustion at the entrance to stability channel 100 is limited to the region corresponding to the gaps between primary burner flames 33, if such gaps exist. The rest of stability channel 100 maintains a reservoir of unreacted gas and hot products because secondary atmospheric oxygen is not able to diffuse into this area.

If the control knob is manipulated to a position corresponding to low input, fuel/air flow decreases into main gas conduit 18 and correspondingly decreases into main fuel chamber 24 producing smaller main flames 33 at primary burner ports 32 creating the desired lower cooking flames. Under these conditions stability channel 100 continues to receive unburned fuel and hot products from primary burner ports 32. The secondary combustion flame front approaches the entrance of stability channel 100 but is not inside stability channel 100 except possibly in the gaps between the primary port flamelets. Secondary atmospheric oxygen is not able to diffuse into all regions of stability channel 100 because the channel walls and the flow exiting primary burner ports 32 restrict access.

Figure 7:
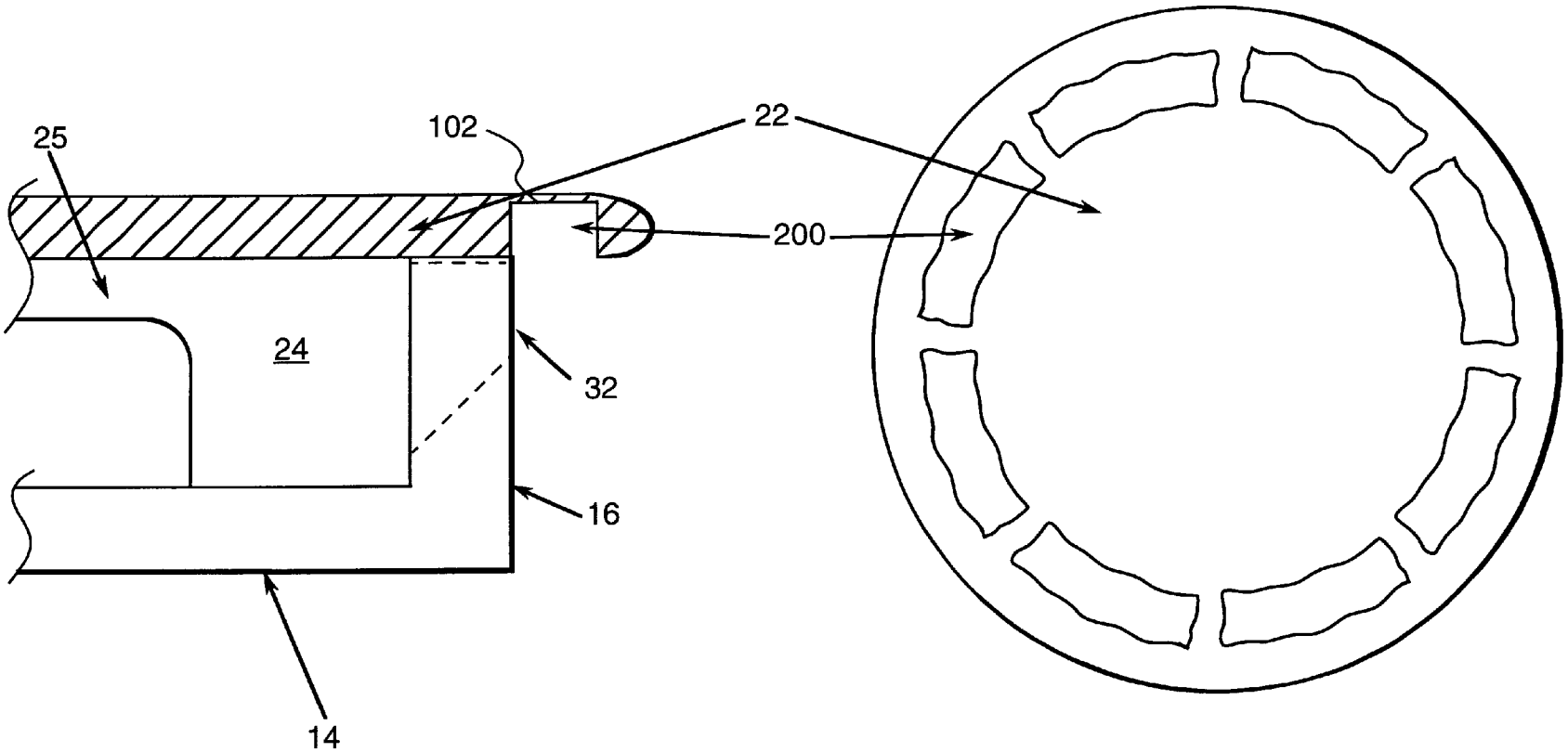
FIG. 7 is a fragmentary cross-sectional side and top view of a gas burner assembly in accordance with another embodiment of this invention.

In accordance with one embodiment of the instant invention, a plurality of stability chambers 200 are disposed within cap 22, as shown in FIG. 7. Cap 22 has an outer portion 102 that extends radially from sidewall 16. Stability chambers 200 are each positioned in outer portion 102 adjacent to respective primary burner ports 32 or sets of primary burner ports 32. Stability chambers 200 function as a series of storage regions for an amount of gas and hot combustion products. The interaction of primary flames 33 (FIG. 2) passing by a respective stability chamber 200 creates a vortex flow pattern within stability chamber 200 that traps a small amount of gas and hot combustion products therein.

If flameout occurs and primary flames 33 are blown out, air mixes with the trapped fuel within stability chamber 200 and sustains a flame front in a respective stability chamber 200. If the fuel air mixture for primary flames 33 resumes impingement on stability chamber 200 within a short period of time, typically, 5–10 milliseconds, either stability chamber 200 flame or the trapped hot products re-ignite the fuel exiting primary burner ports 32.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A gas burner assembly for connection to a source of gas, said gas burner assembly comprising:

a burner body having a sidewall and a tubular main gas conduit, said tubular main gas conduit having an inlet and an outlet;

a plurality of primary burner ports disposed within said sidewall so as to be in communication with said outlet of said tubular main gas conduit;

a surface extending from burner sidewall adjacent to said primary burner ports; and a plurality of stability channel segments disposed within an outer portion of said surface wherein said at least one stability channel is positioned adjacent to the exit of at least one of said primary burner ports to capture a supply of gas and hot products from said burner assembly to re-ignite said primary burner ports after flameout.

2. A gas burner assembly, in accordance with claim 1, wherein said surface extending from said burner sidewall extends above said primary burner ports.

3. A gas burner assembly, in accordance with claim 1, wherein the cross section of said stability channel segments is a semi-circle.

4. A gas burner assembly, in accordance with claim 1, wherein the cross section of said stability channel segments is rectangular.

5. A gas burner assembly, in accordance with claim 1, wherein the volume of said stability channel segments is sufficient to hold an adequate supply of gas and hot products to endure a short flame disruption at said primary burner ports.

6. A gas burner assembly, in accordance with claim 5, wherein the height of a respective stability channel segment is between about ½ to about 1 times the size of said channel segment opening.

7. A gas burner assembly, in accordance with claim 1, wherein a channel opening of a respective stability channel segment is between about 1 to about 3 times the width of a primary burner port.

8. A gas cooking appliance comprising:

a gas burner assembly for connection to a source of gas, said gas burner assembly comprising a burner body having a sidewall and a tubular main gas conduit, said tubular main gas conduit having an inlet and an outlet, a plurality of primary burner ports disposed within said sidewall so as to be in communication with said outlet of said tubular main gas conduit, a burner cap disposed atop said sidewall; and a plurality of stability channel segments disposed within an outer portion of said burner cap wherein said stability channel segments are positioned adjacent said primary burner ports to capture a supply of gas and hot products from said burner assembly to re-ignite said primary burner ports after flameout.

9. A gas burner assembly, in accordance with claim 8, wherein said burner cap is circular and a resepective stability channel segment is annular.

10. A gas burner assembly, in accordance with claim 8, wherein the cross section of a respective stability channel segment is a semi-circle.

11. A gas burner assembly, in accordance with claim 8, wherein the cross section of a respective stability channel segment is rectangular.

12. A gas burner assembly, in accordance with claim 8, wherein the volume of a respective stability channel segment is sufficient to hold an adequate supply of gas and hot products to endure a short flame disruption at said primary burner ports.

13. A gas burner assembly, in accordance with claim 8, wherein a channel opening of a respective stability channel segment is between about 1 to about 3 times the width a primary burner port.

14. A gas burner assembly, in accordance with claim 13, wherein the height of a respective stability channel segment is between about ½ to about 1 times the size of said channel opening.

15. A gas burner assembly for connection to a source of gas, said gas burner assembly comprising:

a burner body having a sidewall and a tubular main gas conduit, said tubular main gas conduit having an inlet and an outlet;

a plurality of primary burner ports disposed within said sidewall so as to be in communication with said outlet of said tubular main gas conduit;

a burner cap disposed atop said sidewall; and a plurality of stability chamber segments disposed within an outer portion of said burner cap wherein said stability chamber segments are positioned adjacent said primary burner ports to capture a supply of gas and hot products from said burner assembly to re-ignite said primary burner ports after flameout.

* * * * *